US006158989A

United States Patent [19]

Barito

[11] Patent Number: 6,158,989

[45] Date of Patent: Dec. 12, 2000

[54] SCROLL COMPRESSOR WITH INTEGRAL OUTER HOUSING AND FIXED SCROLL MEMBER

[75] Inventor: Thomas R. Barito, Arkadelphia, Ark.

[73] Assignee: Scroll Technologies, Arkadelphia, Ark.

[ * ] Notice: This patent is subject to a terminal disclaimer.

[21] Appl. No.: 08/991,068

[22] Filed: Dec. 15, 1997

[51] Int. Cl.[7] ..... F01C 1/02

[52] U.S. Cl. ..... 418/55.1; 418/55.2; 418/181; 418/101

[58] Field of Search ..... 418/55.1, 55.2, 418/181, 101

[56] References Cited

U.S. PATENT DOCUMENTS

| | | | |
|---|---|---|---|
| 2,841,089 | 7/1958 | Jones | 418/55.2 |
| 3,884,599 | 5/1975 | Young et al. | 418/55 |
| 4,466,784 | 8/1984 | Hiraga | 418/55 |
| 4,561,832 | 12/1985 | Shimizu | 418/55 |
| 5,098,265 | 3/1992 | Machida et al. | 418/55.2 |
| 5,201,646 | 4/1993 | Dees et al. | 418/55.5 |
| 5,282,728 | 2/1994 | Swain | 418/55.5 |
| 5,336,068 | 8/1994 | Sekiya et al. | 418/55.2 |
| 5,466,134 | 11/1995 | Shaffer et al. | 418/55.1 |
| 5,478,219 | 12/1995 | Nardone et al. | 418/55.2 |
| 5,564,186 | 10/1996 | Hori et al. | 418/55.2 |
| 5,607,288 | 3/1997 | Wallis et al. | 418/55.5 |
| 5,616,015 | 4/1997 | Liepert | 418/5 |
| 5,632,610 | 5/1997 | Tsubokawa et al. | 418/55.2 |
| 5,641,278 | 6/1997 | Tsumagari et al. | 418/55.2 |

*Primary Examiner*—Thomas Denion
*Assistant Examiner*—Thai-Ba Trieu
*Attorney, Agent, or Firm*—Carlson, Gaskey & Olds

[57] ABSTRACT

An improved housing for scroll compressor has the end cap housing formed integrally with the fixed scroll member. The end cap housing is preferably welded to a tubular housing enclosing the scroll compressor. Most preferably, the end housing has inner and outer tubular portions and the tubular housing extends upwardly into a channel between the inner and outer tubular portions. A muffler is preferably formed integrally with the end cap and extends to a side of the end cap. The present invention further includes heat transfer fins extending from the end cap. The positioning of the muffler to the side decreases the overall length of the compressor. The use of the fins increases the efficiency of compression as heat is removed from the compression chambers. The use of the unique combined end cap and fixed scroll which is welded to the tubular housing simplifies assembly.

19 Claims, 3 Drawing Sheets

Fig-1
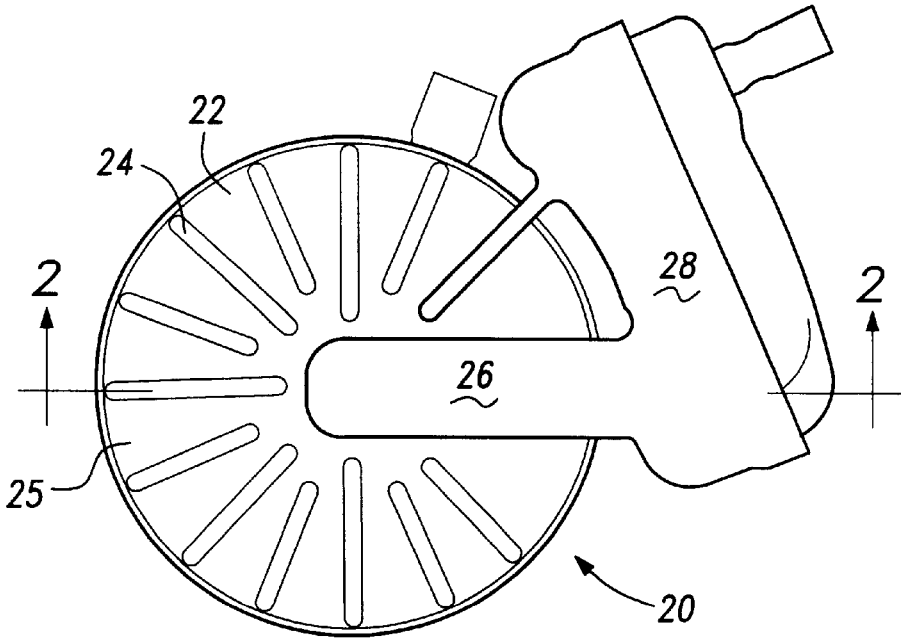
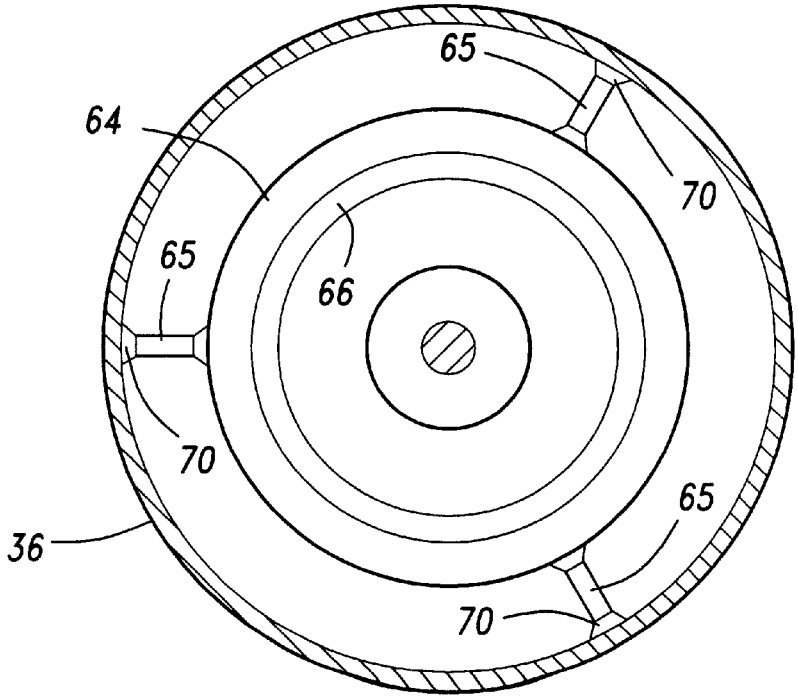
Fig-4

SCROLL COMPRESSOR WITH INTEGRAL OUTER HOUSING AND FIXED SCROLL MEMBER

BACKGROUND OF THE INVENTION

This invention relates to improvements in scroll compressor housings.

Scroll compressors are being utilized in many refrigerant compression operations, since they have many functional benefits when compared to other types of compressors. Thus, scroll compressors are becoming adopted by the compression industry for many applications. There are challenges, however, with scroll compressors.

Typically, a scroll compressor consists of a fixed scroll having a base with a generally spiral wrap extending from the base towards an orbiting scroll. The orbiting scroll has a base with a spiral wrap extending towards the fixed scroll. The orbiting scroll orbits relative to the fixed scroll and compression chambers between the intermeshing scroll wraps are compressed.

It is a desire of the scroll compression industry to minimize the size of the scroll compressor. In particular, it is desirable to minimize the axial length of the scroll compressor. Further, it has been a challenge to remove heat from the scroll compression chambers. Typically, in a sealed scroll compressor, the fixed scroll is mounted at some distance away from an outer housing. Thus, the outer housing is exposed to the ambient environment, but the fixed scroll is separated from the ambient environment, and thus has been somewhat difficult to cool.

The prior art has proposed combining the fixed scroll with the outer housing. However, in general, these designs have proposed bolting the combined fixed scroll and outer housing to a second housing along interface planes. With such a combination it would be difficult to achieve proper positioning of the scroll members, as there is no adjustability provided. Moreover, it is not believed these proposals have ever been in production. To the extent they have, they would be very difficult to assemble.

SUMMARY OF THE INVENTION

In a disclosed embodiment of this invention, a scroll compressor comprises a fixed scroll formed integrally with an outer housing. The compressor is preferably in a sealed canister with a generally tubular housing welded to the combined outer housing and fixed scroll. Preferably, the outer housing is positioned on a radially outer surface of the tubular housing and welded.

More preferably, a muffler is formed integrally with the combined housing and fixed scroll. The muffler preferably extends to the side of the compressor such that it does not increase the overall axial length. Fins also extend from the combined housing and fixed scroll in a direction away from the fixed scroll wrap. The fins provide cooling to remove heat from the compression chambers. Preferably, the muffler and the fins extend away from the base of the fixed scroll member for an approximately equal distance.

In a most preferred embodiment, the combined housing and fixed scroll includes inner and outer tubular portions with the tubular housing member fitting between the inner and outer portions. The tubular housing member can move into and out of a channel formed between the inner and outer tubular portions to allow relative adjustment of the position of the housings. In this way, the position of the scroll members can be carefully controlled. Other housings would also come within the scope of this invention. As one example, only the inner portion need be utilized, with the outer guide portion being eliminated. The tubular housing would still be guided along the inner guide portion and welded.

In a method of assembling the scroll compressor according to this invention, a pump unit is initially assembled by securing the main crankcase bearing to the combined fixed scroll and outer housing. The orbiting scroll is captured between the crankcase and the fixed scroll. This subassembly is then welded to the tubular housing member. Thus, the main crankcase bearing is directly and rigidly secured to the outer housing through this outer weld joint. This provides additional strength to the bearing attachment.

These and other features of the present invention can be best understood from the following specification and drawings, the following of which is a brief description.

BRIEF DESCRIPTION OF THE DRAWINGS

FIG. 1 is a top view of an inventive scroll compressor.

FIG. 4 is a cross-sectional view along line 4—4 of FIG. 2.

DETAILED DESCRIPTION OF THE PREFERRED EMBODIMENT

Figure 2:
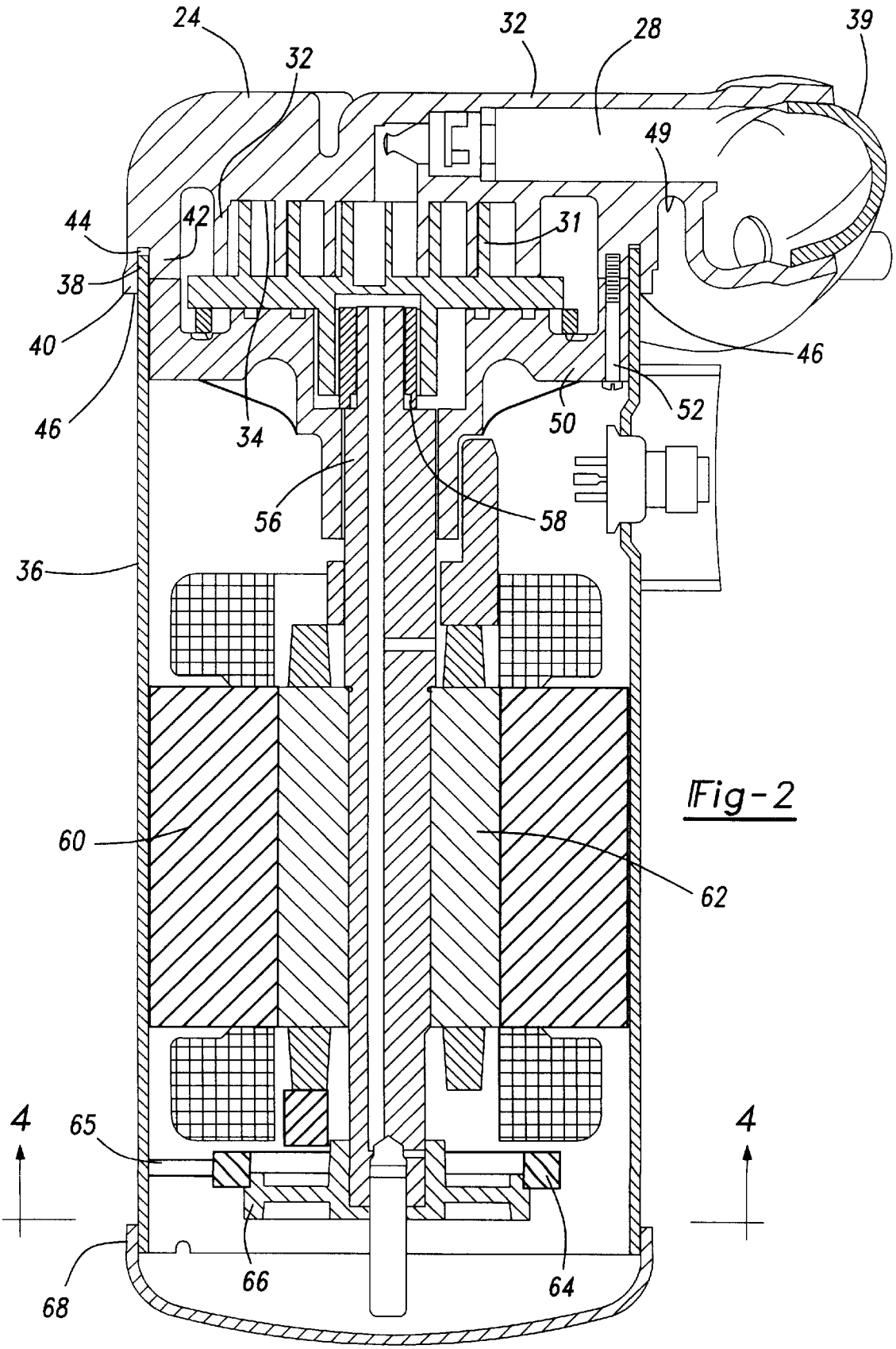
FIG. 2 is a cross-sectional view along line 2—2 of FIG. 1.

An improved scroll compressor 20 is shown in FIG. 1 having an outer housing 22 with fins 24 extending away from a nominal surface plane 25. An outlet passage 26 extends towards a side of the housing 22 and into muffler 28.

As can be seen in FIG. 2, muffler 28 has a top end 32 that is approximately at the same distance as the top of the fins 24. As shown, the muffler is integral with housing 22, and may include a separate cover 39. In this way, the muffler 28 does not add unduly to the axial length of the overall compressor 20. The fins 24 serve to remove heat from the compression chambers within the compressor. Due to the combined outer housing and fixed scroll the fins are very close to the compression chambers, such that they can provide efficient cooling.

Fixed scroll wrap 32 extends from a base 34 formed integrally with outer housing 22. The orbiting scroll 31 interfits with the fixed scroll wrap 32 to define compression chambers, as is known. A tubular housing 36 is welded to outer housing 22. As shown, an end 38 of the tubular housing 36 extends upwardly between inner tubular portion 42 and outer tubular portion 40 of outer housing 22. The inner and outer tubular portions 42 and 40 minimize distortion in the fixed scroll wrap 32.

As shown, the clearance 44 is formed forwardly of end 38. Thus, the end 38 could extend further into the channel if necessary to achieve proper axial positioning.

As also shown in FIG. 2, a notch 49 serves to provide a thermal break between the muffler 28 and the compression chambers. This ensures that there will not be a good deal of heat migration from the muffler 28 back to the compression chambers during operation of the compressor. Also, the cover 39 is preferably welded to the muffler. During this welding operation, the notch 49 also serves as a thermal break to prevent damage to the compressor component.

In assembling this invention, the main crankcase bearing 50 is initially attached to the outer housing 24 as by bolts 52.

The sub-assembly, which would include the main crankcase bearing 50, the orbiting scroll member 31 and the combined fixed scroll and outer housing 28 are then moved into the tubular shell 36. Also, as known, an anti-rotation coupling would be included.

Figure 3:
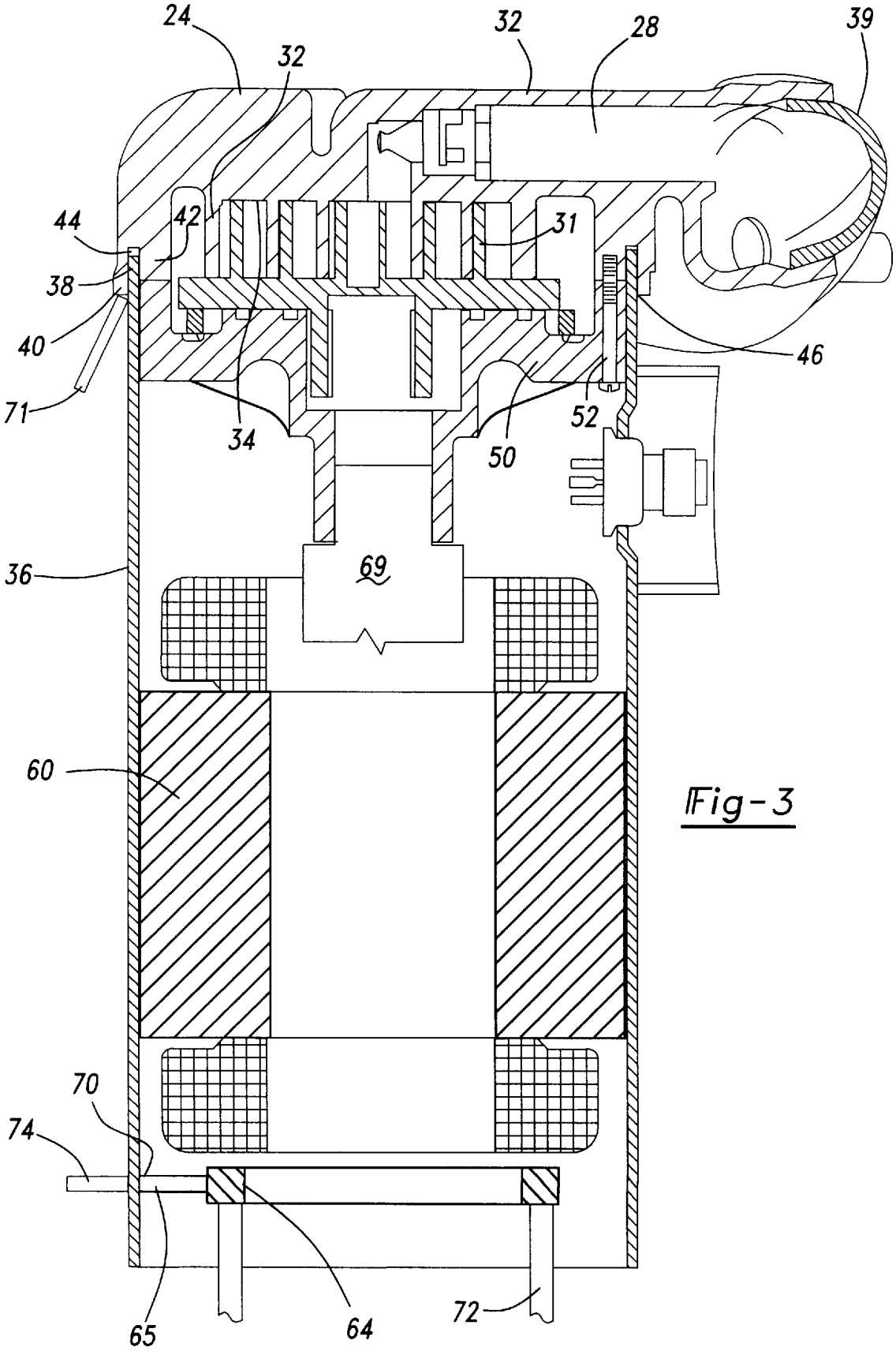
FIG. 3 is a cross-sectional view of an intermediate assembly step.

As shown in FIG. 3, a positioning jig 69, shown schematically initially holds the main crankcase bearing to position the pump sub-assembly prior to welding of the weld joint 46. As shown, a welded tool 71 forms weld joint 46 as jig 69 supports the sub-assembly.

As also shown in FIG. 2, a shaft 56 has a shaft bearing 58 for driving the orbiting scroll 31. As can be appreciated from FIG. 3, this shaft and bearing sub-assembly is not received in the pump assembly when it is being attached to the tubular housing 36.

The motor stator 60 is initially attached to the tubular shell, as shown in FIG. 3. At this time, the motor rotor 62, which is fixed to the shaft 56 is not received within the tubular housing 56.

A lower bearing support 64 has a plurality of arms 65 which are attached to an inner peripheral surface of tubular housing 36. The lower bearing 66 is not received in the housing at the time the lower bearing support 64 is attached. Instead, as shown, a jig 72 is utilized to position and hold the lower bearing support 64 while the arms 65 are welded to the inner peripheral surface of the tubular housing 36 by weld tool 74 extending into an opening in housing 36. Jigs 72 and 69 are shown somewhat schematically.

As shown in FIG. 4, there are preferably several circumferentially spaced arms 65 welded at 70 to housing 36.

Once the crankcase 50 and bearing support 64 have been welded to the tubular housing 36, the jigs 69 and 72 are removed. At that time, the shaft 56, bearing 58 and motor stator 62 and lower bearing 66 can all be moved into the housing. At that time, the lower housing cover 68 may be placed onto the housing to enclose the sealed compression chamber.

By welding the pump sub-assembly directly to the tubular housing 36 the present invention provides a more secure and rigid attachment of the crankcase bearing 50 to the housing 36.

In summary, the present invention discloses a scroll compressor in which the assembly is greatly simplified. Moreover, the required axial length is decreased. The invention also facilitates the removal of heat from the compression chambers, and thus improves overall efficiency. Finally, the attachment method of this invention ensures that there is a more rigid connection of the crankcase bearing to the tubular housing 36, and thus an improved assembly.

Preferably, the combined fixed scroll and outer housing is made of a cast steel, or from a composite casting which includes a cast iron body with a cast in steel outer ring. Alternatively, the housing could be formed entirely of cast iron. The tubular housing 36 is preferably formed of steel, and it is desirable to have a steel-to-steel weld joint. For that reason, it is preferable that the combined outer housing and fixed scroll be formed of a cast steel material.

A worker of ordinary skill in the art would recognize that certain modifications would come within the scope of this invention. For that reason, the following claims should be studied to determine the true scope and content of this invention.

What is claimed:

1. A scroll compressor comprising:

a fixed scroll having a base with a generally spiral wrap extending from said base, an outer housing formed integrally with said fixed scroll;

an orbiting scroll member having a base and a generally spiral wrap interfitting with said spiral wrap of said fixed scroll; and a second housing received and welded to said outer housing, said second housing extending upwardly into a channel between an outer tubular portion and an inner tubular portion on said outer housing.

2. A scroll compressor comprising:

a fixed scroll having a base with a generally spiral wrap extending from said base, an outer housing formed integrally with said fixed scroll;

an orbiting scroll member having a base and a generally spiral wrap interfitting with said spiral wrap of said fixed scroll; and a second housing received and welded to said outer housing, wherein an integral muffler is formed with said outer housing and said fixed scroll.

3. A scroll compressor as recited in claim 2, wherein said second housing extends upwardly into a channel between an outer tubular portion and an inner tubular portion on said outer housing.

4. A scroll compressor as recited in claim 2, wherein said muffler is disposed to a radially outer side of said outer housing.

5. A scroll compressor as recited in claim 4, wherein fins extend from said outer housing in a direction away from said fixed scroll wrap.

6. A scroll compressor as recited in claim 5, wherein said muffler and said fins extend away from said base of said fixed scroll for approximately the same distance.

7. A scroll compressor comprising:

a fixed scroll having a base with a generally spiral wrap extending from said base, an outer housing formed integrally with said fixed scroll;

an orbiting scroll member having a base and a generally spiral wrap interfitting with said spiral wrap of said fixed scroll; and a second housing received and welded to said outer housing, wherein a muffler is disposed to the side of said outer housing.

8. A scroll compressor as recited in claim 1, wherein fins are formed integrally with said outer housing and extend away from said fixed scroll wrap.

9. A scroll compressor comprising:

a fixed scroll having a base with a fixed scroll wrap extending from said base;

an outer housing formed integrally with said fixed scroll, said outer housing having an inner tubular portion defining a space radially outwardly of said inner guide portion; and a second housing extending upwardly into said space, and said second housing being fixed to said outer housing, a muffler being disposed to the side of said outer housing.

10. A scroll compressor as recited in claim 9, wherein said inner tubular portion is spaced from an outer tubular portion and said space is a channel defined between said inner and outer tubular portions, said outer tubular portion being welded to said second housing.

11. A scroll compressor as recited in claim 9, wherein fins extend integrally from said outer housing in a direction away from said fixed scroll wrap.

12. A scroll compressor as recited in claim 9, wherein a muffler is formed integrally with said outer housing.

13. A scroll compressor comprising:

a fixed scroll having a base with a generally spiral wrap extending from said base;

an outer housing formed integrally with said fixed scroll;

an orbiting scroll having a base and a generally spiral wrap interfitting with said spiral wrap of said fixed scroll member;

a second housing connected to said outer housing; and a muffler formed integrally with said outer housing and said fixed scroll, said muffler disposed to a radially outer side of said outer housing.

14. A scroll compressor as recited in claim 13, wherein said second housing extends upwardly into a channel between an outer tubular portion and an inner tubular portion on said outer housing.

15. A scroll compressor as recited in claim 13, wherein fins extend from said outer housing in a direction away from said fixed scroll wrap.

16. A scroll compressor as recited in claim 15, wherein said muffler and said fins extend away from said base of said fixed scroll for approximately the same distance.

17. A scroll compressor as recited in claim 13, wherein said second housing is generally tubular.

18. A scroll compressor as recited in claim 13, wherein said second housing and said outer housing are welded together.

19. A scroll compressor as recited in claim 13, wherein a stamped cap is attached to close said integral muffler.

* * * * *